US010685589B1

(12) United States Patent
Juzefczyk

(10) Patent No.: US 10,685,589 B1
(45) Date of Patent: Jun. 16, 2020

(54) WIRE BOUND NOTEBOOK IDENTIFICATION TAB

(71) Applicant: Wanda Juzefczyk, Las Vegas, NV (US)

(72) Inventor: Wanda Juzefczyk, Las Vegas, NV (US)

(73) Assignee: Wanda Juzefczyk, Las Vegas, NV (US)

( * ) Notice: Subject to any disclaimer, the term of this patent is extended or adjusted under 35 U.S.C. 154(b) by 0 days.

(21) Appl. No.: 16/112,594

(22) Filed: Aug. 24, 2018

Related U.S. Application Data

(60) Provisional application No. 62/605,737, filed on Aug. 24, 2017.

(51) Int. Cl.
*G09F 3/06* (2006.01)

(52) U.S. Cl.
CPC ..... *G09F 3/06* (2013.01); *B42P 2241/16* (2013.01)

(58) Field of Classification Search
CPC ..... G09F 3/06; B42P 2241/16
See application file for complete search history.

(56) References Cited

U.S. PATENT DOCUMENTS 3,335,508 A * 8/1967 Hummel ..... B42F 21/00 40/650
4,645,237 A * 2/1987 Squire ..... B42F 11/02 281/45
4,840,406 A * 6/1989 Pitts ..... B42D 5/008 281/7
5,887,900 A * 3/1999 Raymond ..... B42F 1/08 24/67.9
5,915,873 A * 6/1999 Karlis ..... B42D 5/006 281/38
6,109,812 A * 8/2000 Welch ..... B42F 13/006 281/29
7,052,045 B2 * 5/2006 Park ..... B42D 1/06 116/234
7,406,790 B2 * 8/2008 Gnesa ..... B42B 5/12 40/658
2012/0091015 A1 * 4/2012 Jour ..... B42D 5/005 206/215
2012/0098246 A1 * 4/2012 He ..... B42D 13/00 281/15.1
2016/0332478 A1 * 11/2016 Jameson ..... B42F 21/06
2017/0246902 A1 * 8/2017 Thurlow ..... B43K 23/001

* cited by examiner

*Primary Examiner* — Gary C Hoge

(57) ABSTRACT

A wire bound notebook identification tab is comprised of a writable exterior surface to receive written or labeled identifying information provided to reference the contents or ownership of a wire bound, or spiral bound notebook. The present invention features a hooking mechanism on the underside of each end adapted to secure the unit to the wire or plastic spiraled spine of any such notebook. The writable exterior surface measures comparably to the width of the spine of the spiral notebook with a length appropriate to receive identifying information.

3 Claims, 4 Drawing Sheets

WIRE BOUND NOTEBOOK IDENTIFICATION TAB

TECHNICAL FIELD

The present invention relates to an identification device and more particularly to an identification tab which attaches to the spine of a wire bound notebook and it includes a hook or clip for gripping the wire and or plastic binding (or any binding mechanism) of the wire bound notebook.

Heretofore, the term "wire" may include, but is not limited to wire or plastic spiral binding on notebooks or published books authored by an individual.

The present invention is also composed of a writable surface for receiving or applying written words of information to identify the contents of the wire bound notebook, ownership of the wire bound notebook and/or other information of the like.

This written information may be applied with a writing implement such as a permanent marker, directly onto the outward facing surface of the present invention or, with a printed label produced from a label making device which may be adhered onto the writable surface.

BACKGROUND ART

While wire bound notebooks are stored on a shelf, it is often difficult to identify one wire bound notebook from another. When a consumer has several wire bound notebooks and the notebooks are side by side, it is not possible to identify the contents of their wire bound notebooks as they are currently generally made with identical metal wire with little identifiable differences from one to another.

It would be desirable, therefore to have a mechanism for identifying one wire bound notebook from another. In addition, because wire bound notebooks are often carried in backpacks, carrier pouches, briefcases, purses and the like, it would be desirable to have a clip for securing the identifying information securely to the wire bound binder of each notebook, making searching for the desired notebook easier for the user/owner.

GENERAL SUMMARY DISCUSSION OF INVENTION

It is thus an object of the invention to provide a wire bound notebook identification tab that includes an attaching mechanism to securely hold the identification tab onto the wire binding of a wire bound notebook, and a writable or labeled surface that is part of the attaching mechanism which is positioned on and attached to the wire binding of each notebook. An attachable mechanism may include but is not limited to loop(s), clip(s)—much like that used on "clip pens," or a clamp where a portion of the attaching mechanism of the present invention grips onto the wire of the wire binding used for holding the papers of each notebook within the notebook. The writable surface is suitable for receiving written identifying information such as, the contents or subject matter of the notebook and/or ownership of each notebook or information of the like, to be seen on the exterior of the wire binding of the wire bound notebook.

Accordingly, a wire bound notebook identification tab is provided. The wire bound notebook identification tab may also provide a framed holder as the writable surface in which a paper or card-stock writable tab adapted to receive written information may be slid into a framed holder to be seen on the exterior of the wire bound binder of the wire bound notebook. This surface may be likened to the readable spine of a book, making the contents of the book visible from the side view of the book or notebook as it may appear while placed onto a bookshelf with other books. The hook or clip mechanism which secures the wire bound notebook identification tab onto the wire wire binding does not interfere with the flow of turning pages. The wire bound notebook identification tab may also be used on mass-produced commercially distributed books available to the public through retail stores.

BRIEF DESCRIPTION OF DRAWINGS

For further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
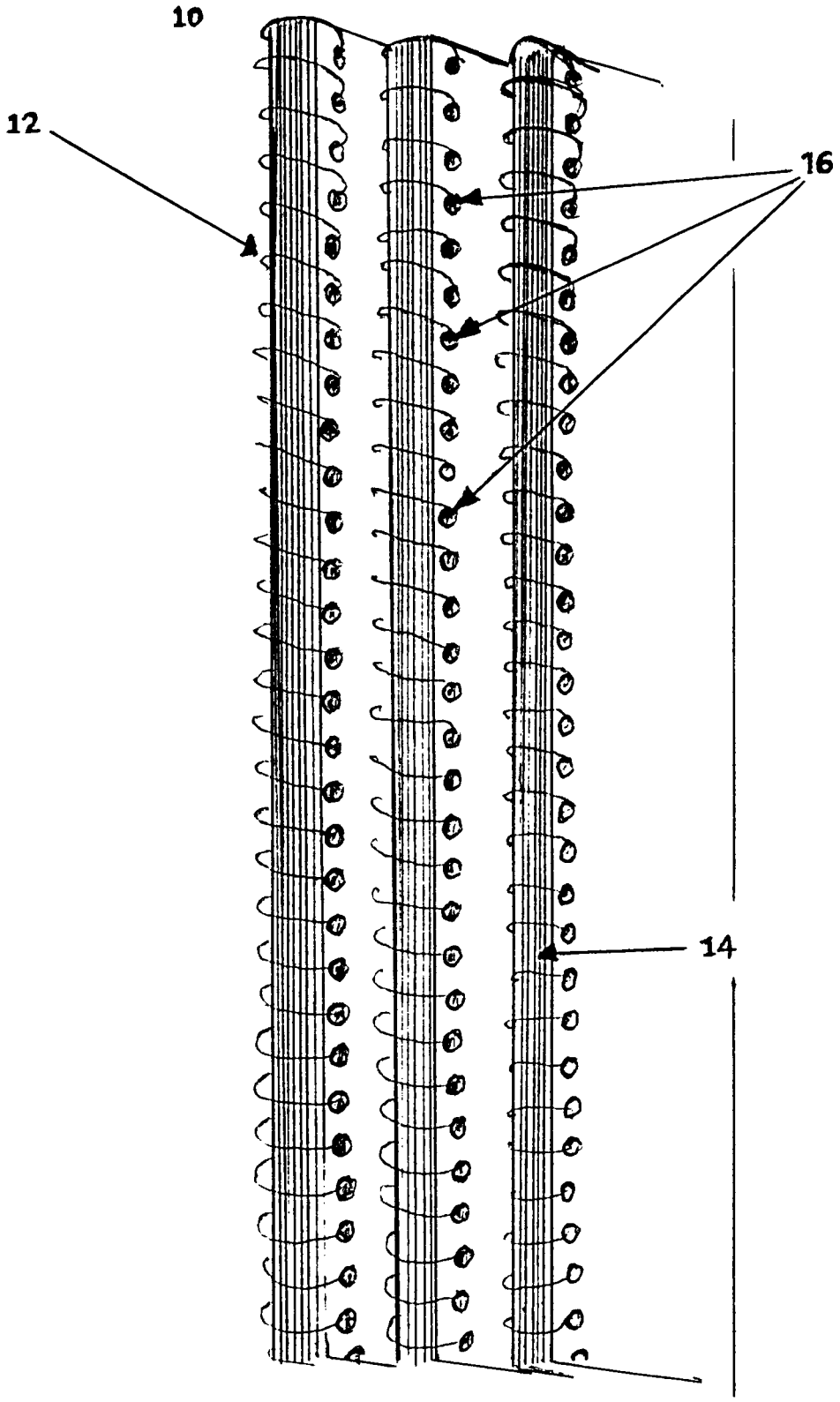
FIG. 1 is a side plan view of representative wire bound notebooks showing the wire binding threaded through a number of binder holes of a quantity of notebook paper.

FIG. 1 shows representative wire bound notebooks, generally designated 10, including a wire binding, generally designated 12, connected to a quantity of notebook papers, generally designated 14, having a number of spaced apart holes along a side edge, generally designated 16, through which wire binding 12 is threaded.

Figure 2:
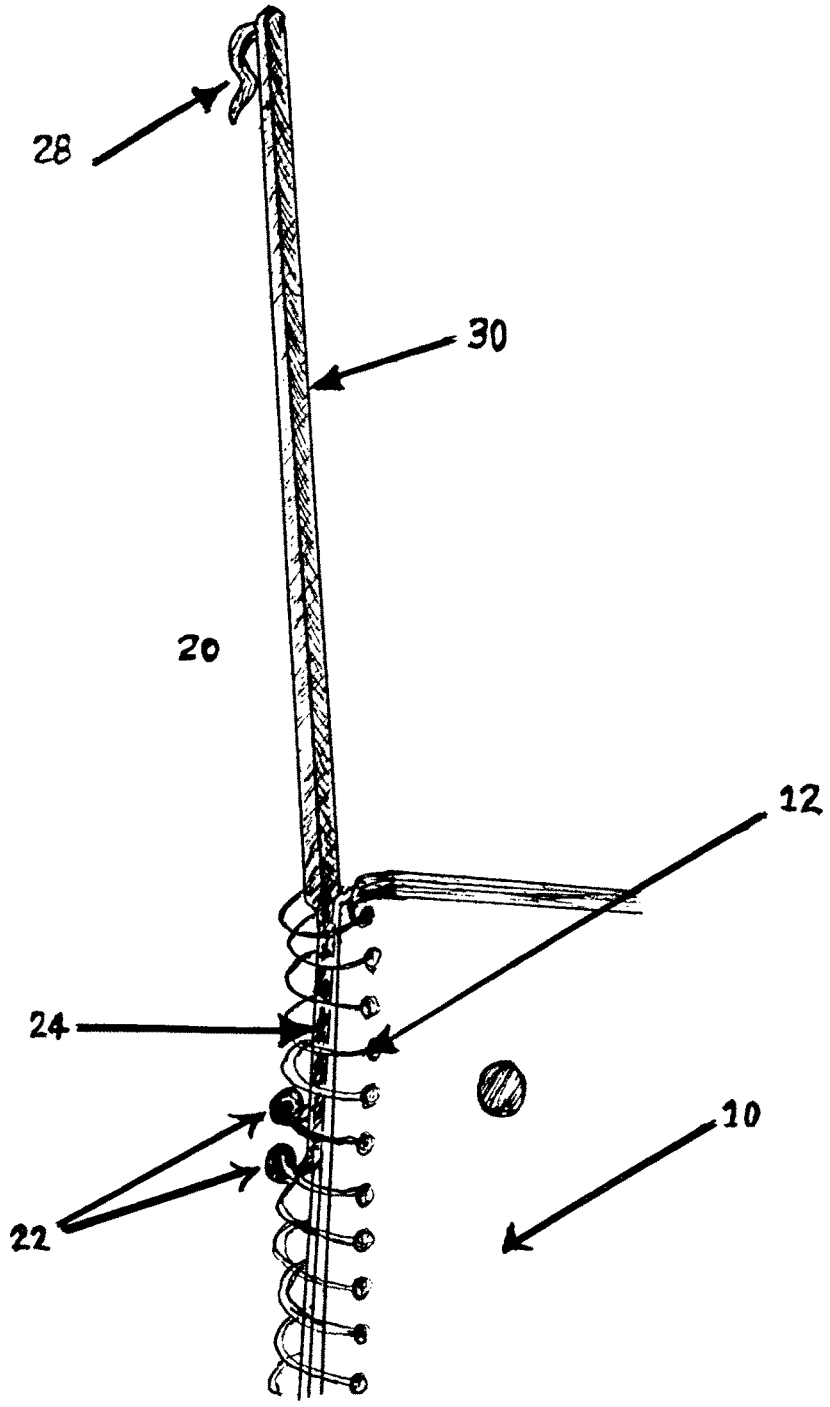
FIG. 2 is a side plan view of the wire bound notebook identification tab attached by loops onto the interior of the wire binding of the notebook. The present invention may include a final attachment from a hook or loop or other gripping mechanism on the under-side of the writable surface to secure the structure into place to the exterior of the wire binding, or any other mechanism which secures the wire bound notebook identification tab onto the wire binding of the notebook.
Figure 3:
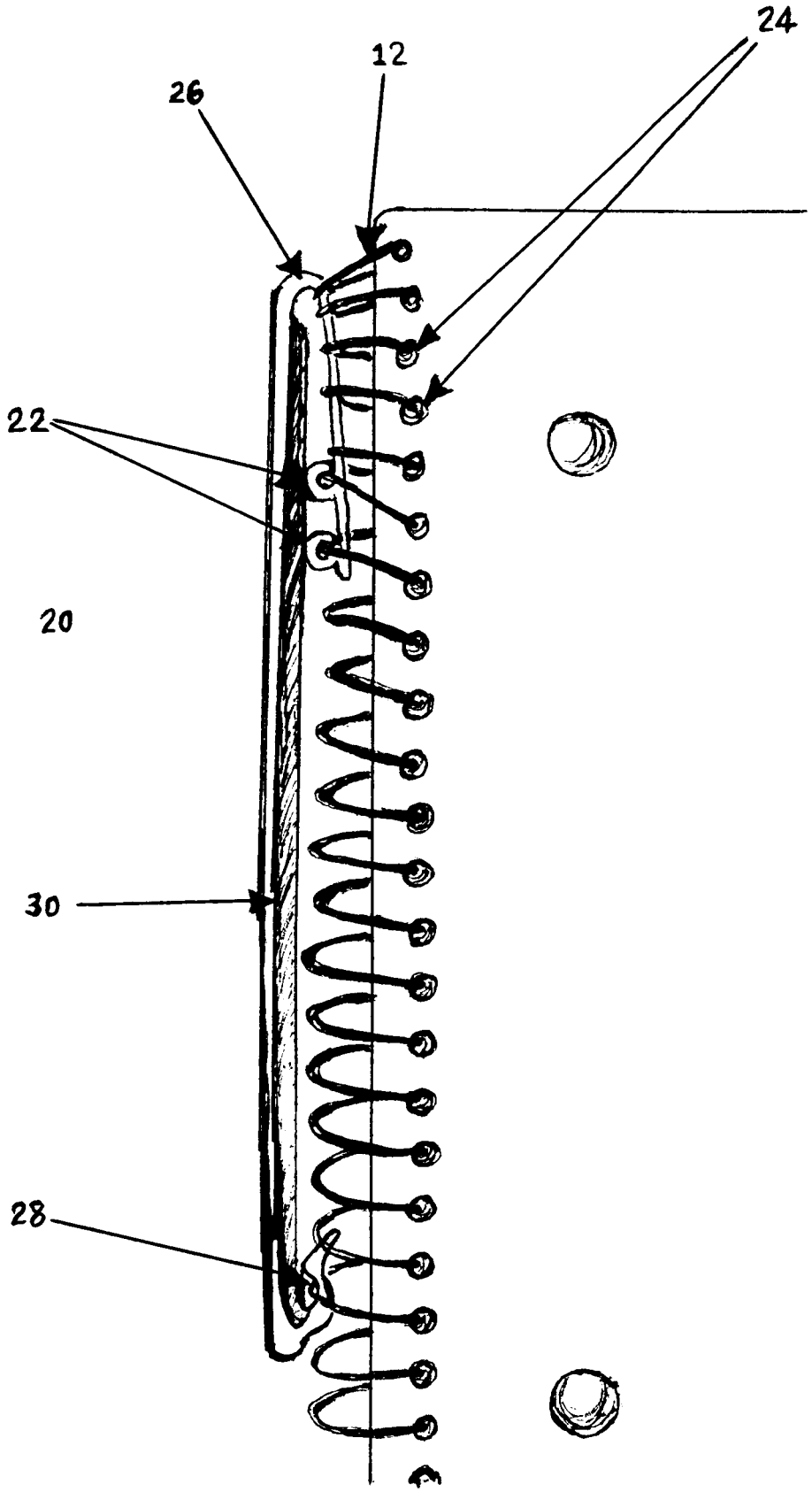
FIG. 3 is a side plan view of an exemplary embodiment of the wire bound notebook identification tab in FIG. 2 secured to the interior of the wire binding of a wire bound notebook of FIG. 1 with the face of the identifying surface secured to the exterior of the wire bound wire binder of the notebook.
Figure 4:
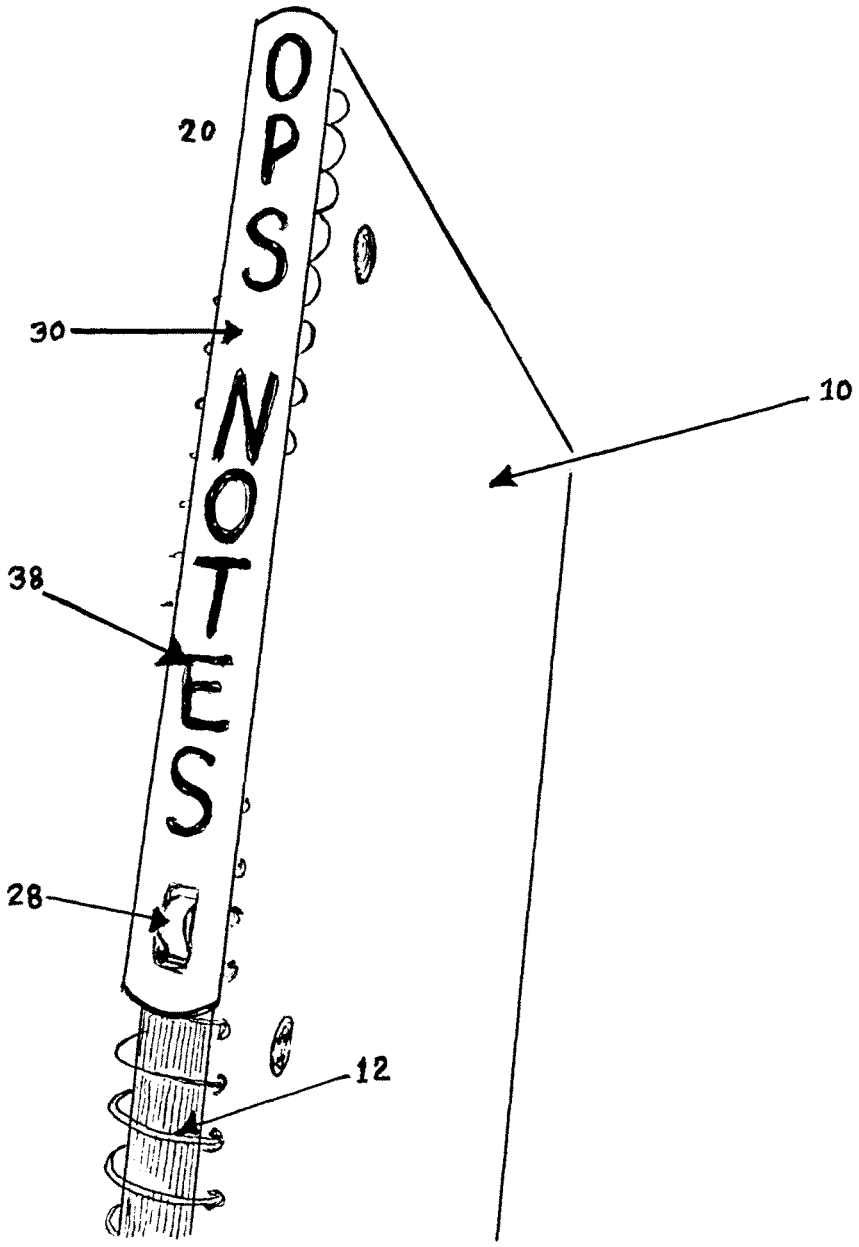
FIG. 4 is a front plan view of an exemplary embodiment of the wire bound notebook identification tab in FIG. 2 secured to the wire binder of a wire bound notebook of FIG. 1 with the face of the identifying surface secured to the exterior of the wire bound wire binder of the notebook.

FIGS. 2 and 3 show various aspects of an exemplary embodiment of the wire bound notebook identification tab of the present invention generally designated 20. Wire bound notebook identification tab includes a clip arm generally designated, 24 for reaching into the interior "tunnel" of the wire binder 12 of a wire bound notebook 10; one or more protruding loop(s) generally designated 22, designated to secure the wire bound notebook identification tab 20 onto a ring of the wire binding mechanism 12; a flat surface which may be comprised of an identifying surface, generally designated 30, provided on a bendable hinge, generally designated 26, from the clip arm, generally designated 24, devised to be secured with a hook, generally designated 28, to the exterior of the wire binder 12 for receiving identifying information to the tab surface 30, adapted to receive written, printed or labeled identification information 38 thereon.

It can be seen from the preceding description that a wire bound notebook identification tab has been provided.

It is noted that the embodiment of the wire bound notebook identification tab described herein in detail for exemplary purposes is subject to different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The invention claimed is:

1. A wire bound notebook identification tab configured to receive alphabetic and/or numeric information upon which to display the contents or ownership of a spiral wire-bound notebook, the wire-bound notebook identification tab comprising:

a writable surface which features a first end and a second end, opposite the first end;

a narrowed elongated member configured for insertion into an interior tunnel of a coiled wire of the wire bound notebook, wherein;

one or more protruding loops upon the elongated member secures the member onto the coiled wire of the spiral notebook, wherein;

the narrowed elongated member includes a bendable hinge attached to the first end of the writable surface.

2. The wire bound notebook identification tab of claim 1 wherein the second end further comprises a hook or clip designated to attach the second end of the writable surface to the coil binding of a notebook.

3. In accordance to claim 2, wherein the hook or clip is located on an underside of the second end of the writable surface.

* * * * *